US006240854B1

(12) United States Patent
Heil

(10) Patent No.: US 6,240,854 B1
(45) Date of Patent: Jun. 5, 2001

(54) PALLETIZING SYSTEM FOR ITEMS ON WHEELS

(75) Inventor: Julius F. Heil, Sharpsburg, GA (US)

(73) Assignee: Burnham Service Company, Inc., Atlanta, GA (US)

( * ) Notice: Subject to any disclaimer, the term of this patent is extended or adjusted under 35 U.S.C. 154(b) by 0 days.

(21) Appl. No.: 09/404,523

(22) Filed: Sep. 23, 1999

Related U.S. Application Data

(63) Continuation-in-part of application No. 09/322,410, filed on May 28, 1999, and a continuation-in-part of application No. 09/322,418, filed on May 28, 1999, now Pat. No. 6,135,031.

(51) Int. Cl.[7] ..... B65D 19/00

(52) U.S. Cl. ..... 108/51.11; 108/57.29; 108/901; 206/320

(58) Field of Search ..... 108/51.11, 53.1, 108/53.3, 57.25, 57.29, 55.1, 55.3, 55.5, 57.28, 901; 206/320, 386; 248/346.02

(56) References Cited

U.S. PATENT DOCUMENTS

| | | | |
|---|---|---|---|
| 2,623,760 | 12/1952 | Fornelius . | |
| 3,478,995 | 11/1969 | Lautzenhiser et al. . | |
| 3,620,388 | 11/1971 | Mansson . | |
| 3,658,195 | 4/1972 | Fantin . | |
| 3,665,869 | 5/1972 | Howe . | |
| 3,675,595 | 7/1972 | Sullivan . | |
| 3,753,407 | 8/1973 | Tilseth . | |
| 3,833,138 | 9/1974 | Dean . | |
| 4,129,927 | 12/1978 | Anderson . | |
| 4,216,568 | 8/1980 | Anderson . | |
| 4,266,756 | 5/1981 | Anderson . | |
| 4,804,087 | 2/1989 | Smith . | |
| 4,829,909 | 5/1989 | Mandel . | |
| 4,886,694 | 12/1989 | Donnard . | |
| 4,911,084 | 3/1990 | Sato et al. . | |
| 5,147,145 | 9/1992 | Facey et al. . | |
| 5,170,721 | 12/1992 | Troth et al. . | |
| 5,398,621 * | 3/1995 | Tanaka et al. | 108/55.3 |
| 5,413,224 * | 5/1995 | Marron et al. | 206/600 |
| 5,423,428 | 6/1995 | Selz . | |
| 5,505,140 | 4/1996 | Wittmann . | |
| 5,524,554 * | 6/1996 | Wilson et al. | 108/901 X |
| 5,651,463 | 7/1997 | Major et al. . | |
| 5,787,817 | 8/1998 | Heil . | |
| 6,006,675 * | 12/1999 | Heil | 108/53.3 X |
| 6,035,790 * | 3/2000 | Polando | 108/57.16 X |

FOREIGN PATENT DOCUMENTS

| | | |
|---|---|---|
| 81 10 297 U | 9/1981 | (DE) . |
| 204 894 | 12/1983 | (DE) . |

(List continued on next page.)

OTHER PUBLICATIONS

Perstorp Xytec, Inc., AgBin Collapsible Containers for Agriculture: AgBin Collapsible Plastic Containers Improve Produce Quality, Reduce Operating Cost, 1995.

Litco International, Inc., Litco Product Information—Nestable Plastic Pallets, 1991.

*Primary Examiner*—Janet M. Wilkens

(74) *Attorney, Agent, or Firm*—Sutherland Asbill & Brennan LLP

(57) ABSTRACT

A palletizing system for a wheeled item comprising an undercarriage and wheels extending from the undercarriage. The pallet includes a plurality of ramps on a base frame sloping from a support toward the base frame and the palletizing system includes at least one selectively removable bridging member for placement in one of the plurality of ramps for forming a track along which the wheels of the item can roll over the one of the plurality of ramps. The support and the plurality of ramps are structured and arranged so that when the bridging member is removed from the at least one of the plurality of ramps and the wheeled item is shifted on the wheels from the support surface along the plurality of ramps, the undercarriage of the wheeled item comes to rest on the support surface.

21 Claims, 4 Drawing Sheets

FOREIGN PATENT DOCUMENTS

| | | |
|---|---|---|
| 82 27 248 U | 1/1984 | (DE) . |
| 94 00 050 U | 4/1994 | (DE) . |
| 0 785 144 A1 | 7/1997 | (EP) . |
| 1 361 066 | 7/1974 | (GB) . |
| 2 210 517 | 6/1989 | (GB) . |
| 2 240 581 | 8/1991 | (GB) . |
| 2 247 899 | 3/1992 | (GB) . |
| 2 247 926 | 3/1992 | (GB) . |
| 2 248 283 | 4/1992 | (GB) . |
| 2 322 408 | 8/1998 | (GB) . |
| 2 322 435 | 8/1998 | (GB) . |
| 1-9157 | 12/1989 | (JP) . |
| WO 91/04137 | 4/1991 | (WO) . |
| WO 95/30844 | 11/1995 | (WO) . |
| WO 97/36123 | 10/1997 | (WO) . |
| WO 98/05564 | 2/1998 | (WO) . |

* cited by examiner

PALLETIZING SYSTEM FOR ITEMS ON WHEELS

CROSS REFERENCE TO RELATED APPLICATIONS

This application is a continuation-in-part of U.S. patent application Ser. Nos. 09/322,410 and 09/322,418, now U.S. Pat. No. 6,135,031 filed on May 28, 1999, the disclosures of which are expressly incorporated herein by reference in their entirety.

TECHNICAL FIELD

This invention relates to pallets for storing a load and systems and methods for palletizing a load. More particularly, this invention relates to securing to pallets a load on wheels such as casters.

BACKGROUND OF THE INVENTION

Goods are often effectively and efficiently stored and transported in stacked configuration. Stacking goods maximizes the use of available storage and transportation space. In addition, it is desirable to manipulate such goods with a forklift for quick handling of the goods. This saves labor and time. Some goods, however, are difficult to store and transport in stacked configuration and are not easily manipulated with a forklift. Wheeled items such as photocopiers on casters are an example of such goods which are difficult to handle.

Typically, an item such as a photocopier on casters has to be placed on skids and secured to the skids to be manipulated with a forklift and stored and transported in stacked configuration. Normally, two laborers and a forklift are required to load and secure a photocopier to skids. The photocopier is secured to the skids by bolting the photocopier to the skids. This is a time consuming task which takes at least about 20 minutes per item.

Alternatively, wheeled items such as photocopiers on casters can be stored on an open floor without stacking the items. Without stacking, however, photocopiers occupy a large space. In addition, photocopiers, unsecured to skids, are difficult to manipulate with a forklift and are rolled about the floor instead. This requires a lot of labor and is time consuming.

Another problem with storing items such as photocopiers on an open floor is that photocopiers are controlled in inventory by serial number. When a specific serial number is requested, an employee must locate the unit within the bulk storage area and retrieve the particular photocopier by moving other photocopiers that obstruct its path. The desired unit is then pushed to the area in which it is to be processed. This is also undesirably time consuming.

Pallets disclosed in U.S. Pat. No. 5,787,817, and U.S. patent application Ser. No. 09/075,632, the disclosures of which are expressly incorporated herein by reference, disclose pallets designed to more effectively and efficiently store and transport items on casters. Those pallets include built-in ramps and tracks for securely positioning an item on casters against a support surface of the pallet. Although such pallets are very effective, they occupy a surface area larger than the stored item because of the area required for the built-in ramps and tracks.

Therefore, there is a need for a system for storing and transporting wheeled items such as photocopiers in a manner that economizes storage space for the items and the amount of material used to make the pallet.

SUMMARY OF THE INVENTION

The present invention fulfills the above described need by providing a method and system for palletizing wheeled items wherein a pallet comprises ramps and selectively removable bridging members for placement in the ramps to form a track along which wheels of the item can roll over the ramps for initial placement of the wheeled item. The bridging members can then be removed so that the wheeled item can be rolled down the ramps until the undercarriage of the item rests on a support surface of the of the pallet. This palletizing system and method eliminates the need for a pallet for having ramps and loading tracks built into the pallet. Only ramps have to be built into the pallet and the removable bridging members form temporary tracks for initially loading the wheeled item.

More particularly, the pallet of this invention includes a base frame having opening for receiving forklift arms and a longitudinal axis extending from a first end to a second end, a support on the base frame and having a support surface for receiving the wheels of the item, and a plurality of ramps on the base frame and sloping from the support toward the base frame. The palletizing system includes at least one selectively removable bridging member for placement in one of the plurality of ramps for forming a track along which the wheels of the item can roll over the one of plurality of ramps. The support and the plurality of ramps are structured and arranged so that when the bridging member is removed from the at least one of the plurality of ramps and the wheeled item is shifted on the wheels from the support surface along the plurality of ramps, the undercarriage of the wheeled item comes to rest on the support surface.

Suitable bridging members include wedges, plates, and any structure that forms a bridge over the ramps so that a wheeled item can be rolled over the ramps.

To load a wheeled item on the pallet, at least one selectively removable bridging member is placed in one of the plurality of ramps for forming a track along which the wheels of the item can roll over the one of the plurality of ramps. The wheeled item is rolled onto the pallet along the support surface and the track formed by the bridging member. The at least one bridging member is then removed and the wheeled item is shifted on its wheels from the support surface along the plurality of ramps until the undercarriage of the wheeled item comes to rest on the support surface.

Other objects, features, and advantages of the present invention will become apparent from the following detailed description, drawings, and claims.

DETAILED DESCRIPTION OF DRAWINGS

Figure 1:
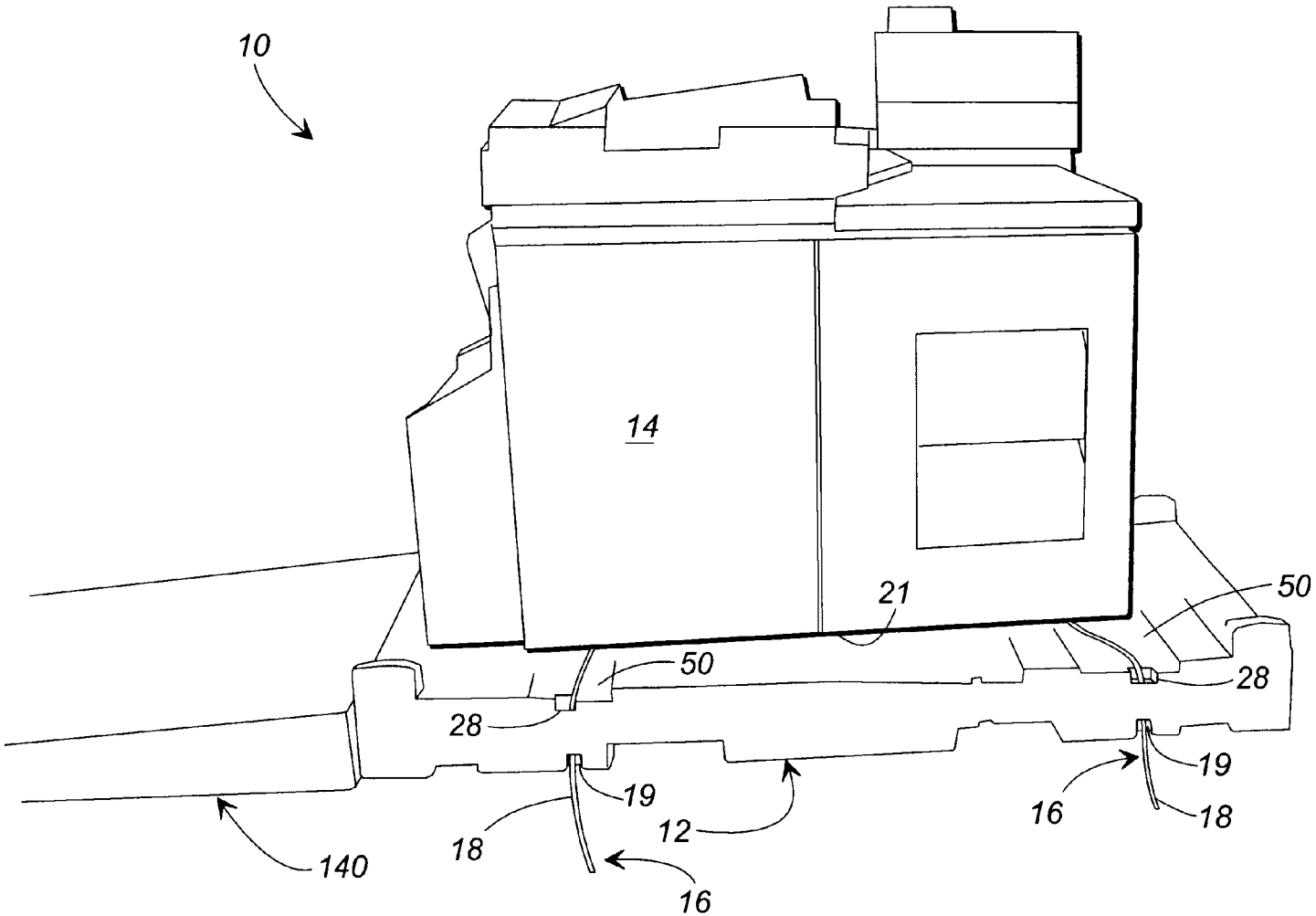
FIG. 1 is a perspective view of a loaded palletizing system in accordance with an embodiment of this invention.

As summarized above, this invention encompasses a method and system for palletizing wheeled items. In the drawings, like numerals reference like parts throughout the several views. FIG. 1 illustrates a palletizing system 10 made in accordance with an embodiment of this invention. This palletizing system 10 includes a pallet 12 for holding a load 14, a plurality of bridging members 15, and a plurality of anchoring systems 16 engaged at different positions spaced about the pallet for securing the load to the pallet.

Each anchoring system includes a strap 18 and a clamping mechanism 19 for releasably securing the load and the anchoring system to the pallet. The anchoring systems 16 are disclosed in U.S. patent application Ser. Nos. 09/322,410 and 09/322,418, the disclosures of which are expressly incorporated herein by reference.

The palletizing system 10 is particularly suited for palletizing wheeled items. The item 14 shown in FIG. 1 is a photocopier having wheels 11 or casters extending below an undercarriage 21.

Figure 2:
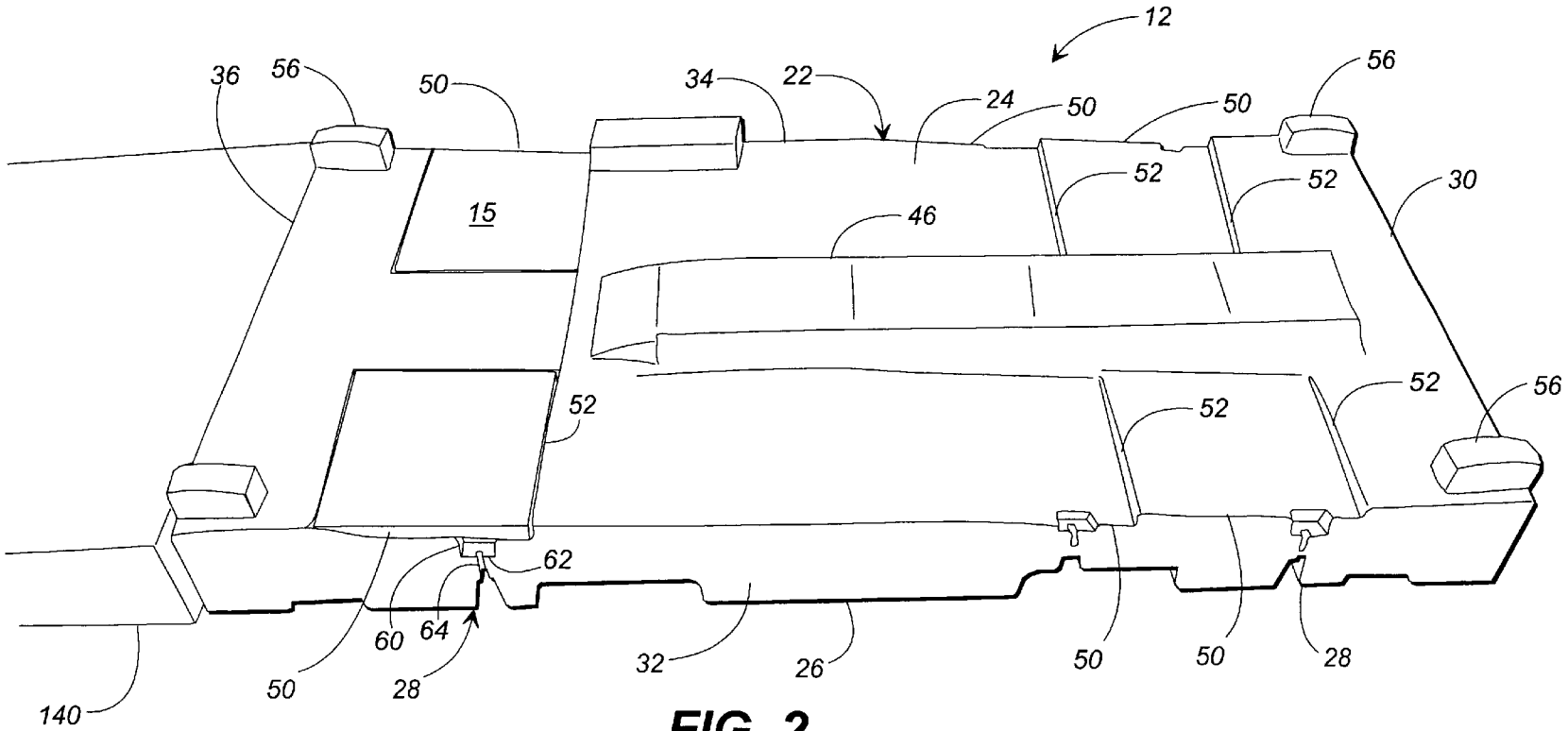
FIG. 2 is a perspective view of an unloaded pallet made in accordance with an embodiment of this invention.
Figure 3:
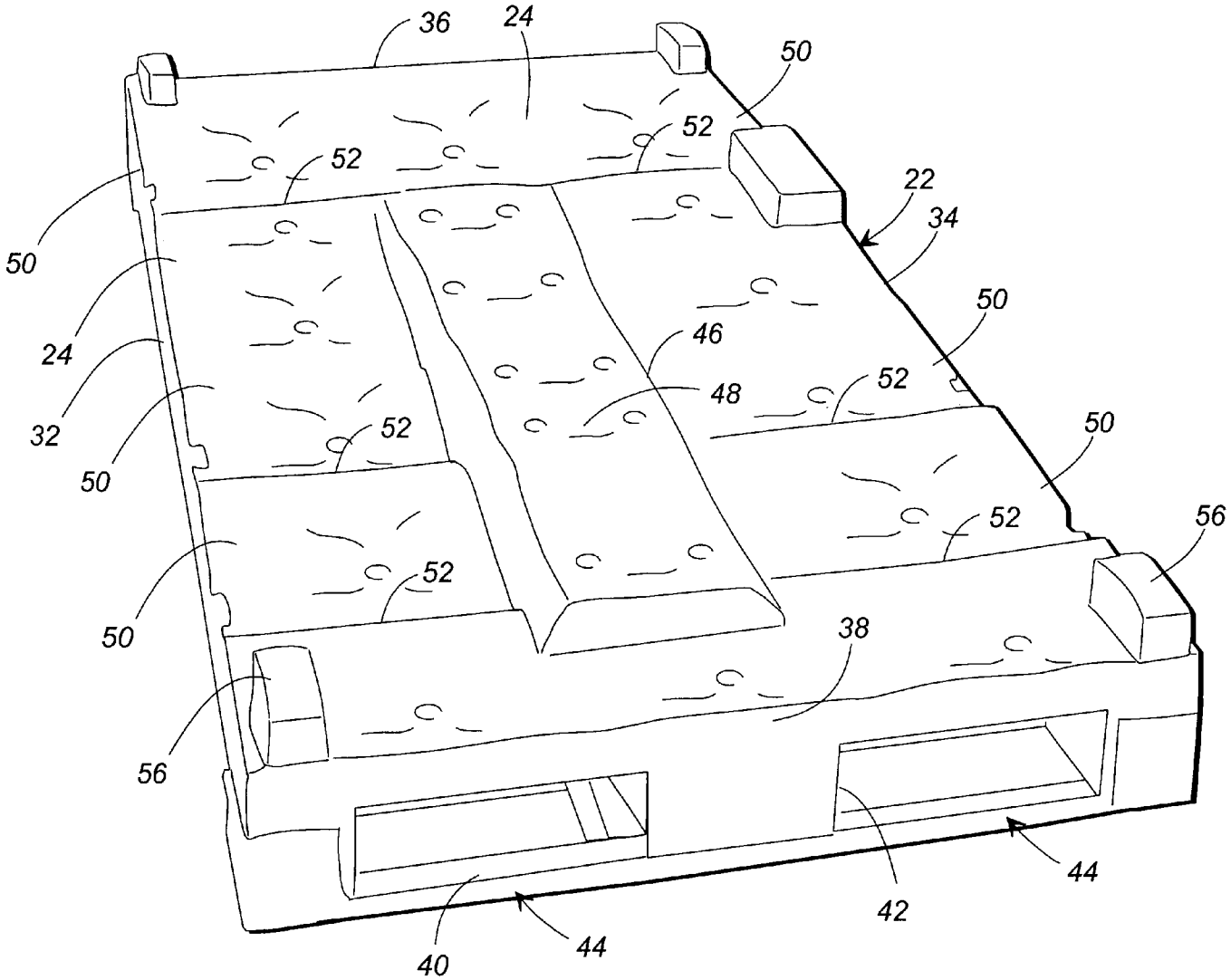
FIG. 3 is a perspective end view of the pallet illustrated in FIG. 2.

As shown in FIGS. 2 and 3, the pallet 12 comprises a substantially rectangular base frame 22 having an upper face or support surface 24 which supports the load on the pallet and a downwardly facing lower face 26. The pallet 12 also includes a plurality of housings 28 for receiving respective clamping mechanisms 19 of the anchoring device 16. The housings 28 are desirably spaced about the periphery of the pallet 12 with at least one housing proximate each corner of the pallet.

The pallet base frame 22 comprises a substantially rectangular platform 30 which includes the support surface 24 and sidewalls 32 and 34 which extend along edges of the platform from one end 36 of the base frame to another end 38 of the base frame. Lower panels 40 extend laterally between the sidewalls 32 and 34 at each of the ends 36 and 38 of the base frame 22 and a central support 42 extends along the length of the base. The lower panels 40, central support 42, and platform 30 form forklift channels 44 at each end of the pallet 12.

Figure 4:
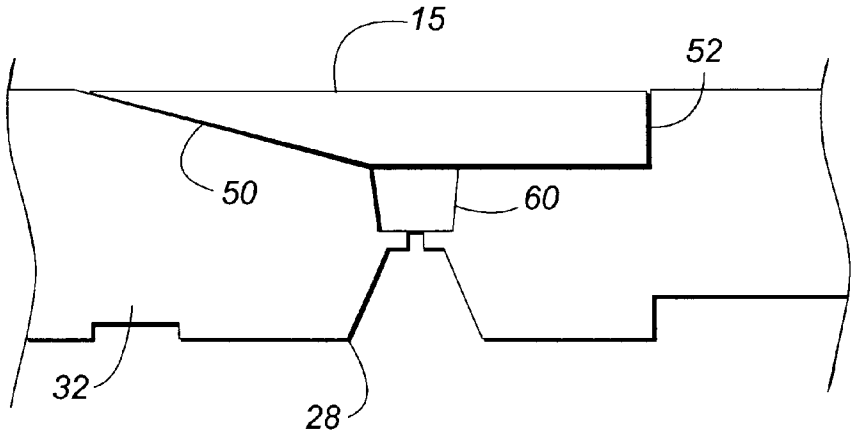
FIG. 4 is a partial elevation view of a bridging member positioned on the pallet illustrated in FIG. 2.

The platform 30 includes an elongated support member 46 on which the load 14 rests when fully loaded on the pallet 12. The support member 46 extends from the pallet 12 in a direction away from the base frame 22. The platform 30 also includes a series of ramps 50 separated by steps 52 such that the ramps 50 slope downwardly from the support surface 24 of the pallet base frame 22 toward the lower face 26. The bridging members 15, which are shown in FIGS. 2 and 4 as removable wedges, can be placed on the ramps 50 to form a level track for rolling the load 14 on its wheels 11 onto the pallet 12. After the wheeled item 14 is loaded onto the pallet 12 using the bridging members 15, the bridging members are removed and the wheeled item is rolled on its wheels 11 down the ramps 50 until the undercarriage 21 of the item rests on the elongated support member 46 which forms part of the support surface 24. The plurality of ramps 50 are sloped toward the base frame 22 relative to the support member 46 such that at least a portion of the weight of the wheeled item 14 is shifted from the wheels 11 of the item to the support member when the wheeled item is shifted on its wheels 11 along the plurality of ramps so that the undercarriage 21 of the wheeled item comes to rest on the support member.

Figure 5:
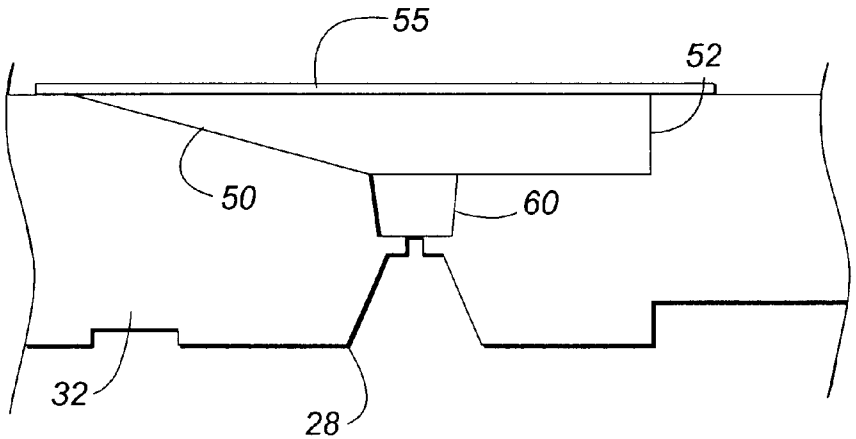
FIG. 5 is a partial elevation view of an alternative bridging member positioned on the pallet illustrated in FIG. 2.

Although the bridging member is shown as a wedge in FIGS. 2 and 4, suitable bridging members also include rigid plates 55, shown in FIG. 5, and other structures which form a temporary bridge over the ramps 50 and can support the weight of the item being loaded on the pallet.

Stacking members 56 extend from each corner of the pallet 12 and nest into corresponding passages (not shown) in the lower face 26 of another pallet for stacking the pallets. Reinforcing members (not shown) extend longitudinally and laterally across the lower face 26 of the pallet base 22 to strengthen the pallet 12.

Each of the housings 28 for the clamping mechanisms 19 are an integral part of the pallet 12 and are positioned along the sides 32 and 34 of the pallet, one proximate each corner of the pallet. As shown in FIG. 4, a recess 60 extends above each housing 28 in the respective one of the sidewalls 32 and 34. Each recess 60 extends from the support surface 24 of the pallet 12, toward the lower face 26, to a rectangular abutment 62. The abutment 62 has an aperture 64 for receiving the strap 18 of the anchoring device 16. The aperture 64 is sized to prevent the clamping mechanism 19 from passing through the aperture when the clamping mechanism is disposed in the housing 28. The housings 28 should be sized so that the clamping mechanisms 19 fit within the housings and are accessible for manipulation by tools such as a blind rivet gun.

Each anchoring device 16 includes a strap 18 and a clamping mechanism 19 for selectively receiving and clamping to the strap and alternatively releasing the strap. The strap is desirably a wire rope which can be constructed of various materials including aluminum, steel, zinc, nickel, other alloys, polymers, composite materials, and the like. The strap 18 can optionally be coated with plastic, rubber, or other polymer or alloy based material.

The strap 18 includes an attachment at one end and has a loose end for feeding through the clamping mechanism 19. Suitable attachments include wire loop, a hook, bolt, slider pin or plate, a u-bolt, and the like. The attachment attaches the strap 18 to the load 14 on the pallet 12 to secure the load to the pallet. Alternatively, the attachment can be attached to one end or side of the pallet while the strap 18 is passed over the load and secured to the other end or side of the pallet with the clamping mechanism 19.

The clamping mechanism 19 is a reusable, selectively releasable clamping mechanism such as that disclosed in U.S. patent application Ser. Nos. 09/322,410 and 09/322,418, the disclosures of which are already incorporated herein by reference.

The pallet 12 illustrated in FIG. 1 is loaded with a load 14 on casters by placing the leading end 36 of the pallet adjacent a loading ramp 140 and placing removable bridging members such as wedges 15 at both ends of the first ramps 50 adjacent the leading end 36 of the pallet. The removable wedges 15 allow the front wheels 11 of the load 14, which is a photocopier in FIG. 1, to roll smoothly onto the platform 30 the pallet 12. The removable wedges 15 can then be moved to other ramps 50 as necessary to position the casters of the load 14 for lowering onto the support member 46. The wedges 15 are then removed and the load 14 is rolled on its casters down the ramps 50 in the pallet platform 30 until the undercarriage 21 of the load rests firmly on the support surface 24 of the elongate member 46. The load 14 is then secured to the pallet 12 with the anchoring devices 16 or other suitable attachments.

The pallet 12 is made of a material sufficient to withstand the weight of items loaded onto it and repeated handling. Various materials include plastics, metal, wood and the like.

Desirably, the pallet 12 is made of injection-molded polymer resin such as high-density polyethylene.

It should be understood that the foregoing relates to particular embodiment of the present invention, and that numerous changes may be made therein without departing from the scope of the invention as defined by the following claims.

I claim:

1. A palletizing system for a wheeled item comprising an undercarriage and wheels extending from the undercarriage, the palletizing system comprising:

a pallet including:

a base frame having openings for receiving fork lift arms and a longitudinal axis extending from a first end to a second end;

a support on the base frame and having a support surface for receiving the wheels of the item; and a plurality of ramps on the base frame and sloping from the support toward the base frame; and at least one selectively removable bridging member for placement in one of the plurality of ramps for forming a track along which wheels of the item can roll over the one of the plurality of ramps, the support and the plurality of ramps structured and arranged so that when the bridging member is removed from the at least one of the plurality of ramps and the wheeled item is shifted on the wheels from the support surface along the plurality of ramps, the undercarriage of the wheeled item comes to rest on the support surface.

2. A palletizing system as in claim 1 wherein the at least one bridging member is a wedge.

3. A palletizing system as in claim 1 wherein the at least one bridging member is a plate.

4. A palletizing system as in claim 1 further comprising at least a second bridging member for placement in one of the plurality of ramps.

5. A palletizing system as in claim 1 wherein the support includes a support member extending from the pallet in a direction away from the base frame so that when the wheeled item is shifted on the wheels from the support along the plurality of ramps, the undercarriage of the wheeled item comes to rest on the support member.

6. A palletizing system as in claim 5 wherein the support member extends away from the base frame beyond the plurality of ramps.

7. A palletizing system as in claim 6 wherein the support member extends along the longitudinal axis substantially perpendicularly to the plurality of ramps which extend from each side of the support member toward respective sides of the base frame.

8. A palletizing system as in claim 5 wherein the plurality of ramps are sloped toward the base frame relative to the support member, whereby at least a portion of a weight of the wheeled item is shifted from the wheels of the item to the support member when the wheeled item is shifted on the wheels from the support along the plurality of ramps so that the undercarriage of the wheeled item comes to rest on the support member.

9. A palletizing system as in claim 1 wherein the pallet further comprises an anchor for securing a strap for holding the wheeled item onto the pallet.

10. A palletizing system as in claim 1 wherein the pallet is made of polymer resin.

11. A palletizing system as in claim 1 wherein the pallet is made of injection-molded polymer resin.

12. A palletizing system as in claim 11 wherein the polymer resin is high-density polyethylene.

13. A method for loading a wheeled item on a pallet comprising the steps of:

providing the wheeled item comprising an undercarriage and wheels extending from the undercarriage;

providing a pallet comprising:

a base frame having openings for receiving fork lift arms and a longitudinal axis extending from a first end to a second end;

a support on the base frame and having a support surface for receiving the wheels of the item; and a plurality of ramps on the base frame and sloping from the support toward the base frame;

forming a track over one of the plurality of ramps by placing at least one selectively removable bridging member in the one of the plurality of ramps;

rolling the wheeled item onto the pallet along the support surface and the track formed by the bridging member;

removing the at least one bridging member; and shifting the wheeled item on the wheels from the support surface along the plurality of ramps until the undercarriage of the wheeled item comes to rest on the support surface.

14. A method as in claim 13 wherein the at least one bridging member is a wedge.

15. A method as in claim 13 wherein the at least one bridging member is a plate.

16. A method as in claim 13 further comprising placing at least a second bridging member in one of the plurality of ramps.

17. A method as in claim 13 wherein the support includes a support member extending from the pallet in a direction away from the base frame so that when the wheeled item is shifted on the wheels from the support along the plurality of ramps, the undercarriage of the wheeled item comes to rest on the support member.

18. A method as in claim 17 wherein the support member extends away from the base frame beyond the plurality of ramps.

19. A method as in claim 18 wherein the support member extends along the longitudinal axis substantially perpendicularly to the plurality of ramps which extend from each side of the support member toward respective sides of the base frame.

20. A method as in claim 17 wherein the wheeled item has a weight and the plurality of ramps are sloped toward the base frame relative to the support member such that at least a portion of the weight is shifted from the wheels of the item to the support member when the wheeled item is shifted on the wheels from the support along the plurality of ramps so that the undercarriage of the wheeled item comes to rest on the support member.

21. A method as in claim 13 further comprising strapping the wheeled item onto the pallet.

* * * * *